US006003456A

United States Patent [19]

Lee

[11] Patent Number: 6,003,456

[45] Date of Patent: Dec. 21, 1999

[54] HEM FORMER AND SEWING APPARATUS

[75] Inventor: John Y. Lee, Orange, Calif.

[73] Assignee: Orange County Industrial Sewing Machine Co., Inc., Santa Ana, Calif.

[21] Appl. No.: 09/079,657

[22] Filed: May 15, 1998

[51] Int. Cl.[6] ..... D05B 35/02

[52] U.S. Cl. ..... 112/475.06; 112/141; 112/147

[58] Field of Search ..... 112/475.26, 475.06, 112/141, 153, 147, 136, DIG. 2, 475.03

[56] References Cited

U.S. PATENT DOCUMENTS

| | | | |
|---|---|---|---|
| 3,252,437 | 5/1966 | Pickett | 112/136 |
| 3,631,826 | 1/1972 | Morgan . | |
| 4,506,613 | 3/1985 | Ragnebring . | |
| 4,624,200 | 11/1986 | Fisher . | |
| 4,655,150 | 4/1987 | Romano . | |
| 4,817,544 | 4/1989 | Ackermann et al. . | |
| 5,197,400 | 3/1993 | Prais . | |
| 5,373,797 | 12/1994 | Bottoms et al. | 112/DIG. 2 X |
| 5,411,002 | 5/1995 | Satoma . | |
| 5,411,004 | 5/1995 | Bottoms et al. . | |
| 5,476,053 | 12/1995 | Brocklehurst . | |
| 5,579,707 | 12/1996 | Erwin . | |
| 5,598,798 | 2/1997 | Ng . | |

FOREIGN PATENT DOCUMENTS

| | | |
|---|---|---|
| 28 46 273 A1 | 5/1979 | Germany . |
| 614139 | 7/1978 | U.S.S.R. . |

*Primary Examiner*—Ismael Izaguirre

*Attorney, Agent, or Firm*—Knobbe, Martens, Olson & Bear, LLP

[57] ABSTRACT

An air assisted hem former for folding a margin of a foldable material which uses at least one stream of air to urge margin material through a folded cavity. The folded cavity and airflow moves the margin toward a sewing needle, directs the margin material to a proper stitching position and maintain the stitching position until the needle has stitched the hem. Two similarly formed hem formers can be mounted on opposing sides of a sewing needle to urge, direct and maintain the margin material prior to stitching of a hem.

37 Claims, 4 Drawing Sheets

HEM FORMER AND SEWING APPARATUS

BACKGROUND OF THE INVENTION

1. Field of the Invention

The present invention relates in general to an apparatus for folding margins of flexible materials and, more particularly, to an air enhanced hem former to be used with a sewing machine.

2. Description of the Prior Art

Materials used in the manufacture of clothing, such as cotton, polyester, rayon and other cloth materials invariably have an end, or margin. The margin is typically folded and sewn to form a hem. The hem provides strength to the clothing, prevents fraying, evens the length of the margin, and allows for subsequent length adjustments. Hems are formed in a variety of ways.

One common method of forming a hem is to manually fold the margin back onto the material and then hand or machine stitch the margin to the material. However, this method is very time consuming and requires skilled operators. Another common method of forming a hem uses a thin plate to fold the margin around and then back onto the material. Once the margin is so positioned, an operator can hand or machine stitch the margin to the material. However, it is often difficult, if not impossible, for an operator to quickly and accurately fold the margin around the plate and into position for stitching.

To overcome the problems relating to quickly and accurately folding the margin into a proper stitching position, streams of compressed air have been used. One such design is illustrated by U.S. Pat. No. 3,631,826 issued to Morgan. Morgan apparently discloses a hem former in which the path traveled by the margin during sewing uses an airflow outlet formed below the margin and below a support plate, with the airflow perpendicular thereto. A deflector 44, 58 perpendicularly deflects the airflow toward the margin so that the margin is carried by the airstream toward the sewing needle whereas other airstreams guide the margin through multiple folds for stitching parallel to the margin. However, this airstream design causes the margin to flutter when in the airstream and inefficiently directs the margin toward the stitching needle because of the 90° angle change which the airstream undergoes. Further, margin positioning is not maintained during stitching.

Another air enhanced hem former design is illustrated by U.S. Pat. No. 5,441,004 issued to Bottoms. Bottoms apparently discloses an airflow outlet that is angularly formed toward the rear bottom portion of a support plate 22. The margin is manually urged across the plate, then vertically downward below the plate, and only then does the margin 13 enter the airstream. Thus, an operator must manually urge the material across the plate and then vertically downward over the edge of the pate before the margin enters the airstream 37. Only after this manual urging can the airstream fold and direct the margin into position for stitching. However, manual urging of the margin can cause the margin to snag, bunch, or misalign before entering into the airstream.

Additionally, the prior art does not address the problem of maintaining the margin in a proper position after being directed by the airstream. Thus, after the airstream folds and directs the margin but before the stitching process is completed, the margin can become mispositioned. This results in improperly stitched margins.

There is thus a need for a hem former which urges the material toward the needle, directs the material to a proper sewing position and maintains this proper sewing position until the needle has stitched the hem.

SUMMARY OF THE INVENTION

The present invention provides a hem former which uses at least one stream of pressurized air to urge a margin of a material toward a needle, direct the margin to a proper stitching position, and maintain this proper stitching position until the needle has stitched the hem.

One aspect of the invention involves an air-enhanced hem former for folding a margin of a foldable material to be stitched. The hem former has a first, generally U-shaped cavity having first and second legs and a bottom joining the legs. The cavity is sized to allow air to carry the margin through the cavity. At least one outlet opens into the first leg and is directed toward the bottom to introduce an airstream into the cavity. The outlet may be located along the first leg and before the bottom.

The hem former described above may further comprise a second, generally U-shaped cavity having first and second legs and a bottom joining the legs. The second cavity is also sized to allow the airstream to carry the margin through the second cavity. At least one outlet opens into the first leg of the second cavity and is directed toward the bottom of the second cavity to introduce an airstream into the second cavity. The outlet may be located along the first leg and before the bottom of the second cavity. If two such hem formers are used, they are aligned so a margin can be inserted through each hem former, and are spaced apart a distance sufficient to allow a needle to sew the margin between the hem formers.

Another aspect of the present invention includes an air-assisted sewing apparatus comprising a first cavity having a U-shaped portion formed by a first and second generally parallel legs joined by a curved bottom. The first leg has an end opposite the bottom that forms an opening into which the margin is introduced to the cavity. An outlet is in fluid communication with an air source and orientated to introduce an airstream into the first leg directed toward the bottom. The size of the first cavity and the airstream cooperate to move the margin through the cavity to an end of the second leg. Also, a second apparatus having a second cavity constructed as the first cavity, may be used. If used, the second cavity is generally parallel to and separated from the first cavity a distance sufficient to allow a needle to stitch the margin between the cavities.

Yet another aspect of the invention involves a sewing apparatus which has a first passageway with a U-shaped portion formed by a first and second generally parallel legs joined by a curved bottom. The first leg of the U-shaped portion has an end opposite the bottom that forms an opening into which the margin is introduced to the passageway. A first airflow means is in fluid communication with the first leg for moving the margin through the passageway to an end of the second leg. Optionally, the sewing apparatus may further include a second passageway having a U-shaped portion formed by first and second generally parallel legs joined by a curved bottom. If used, the first leg of the second passageway has an end opposite the bottom that forms an opening into which the margin is introduced to the second passageway. A second airflow means in fluid communication with the first leg of the second passageway moves the margin through the second passageway to an end of the second leg of the second passageway. The second passageway may be aligned with the first passageway and separated from the first passageway a distance sufficient to allow a needle to stitch the margin between the passageways.

The present invention also includes a method for folding a margin of a foldable material to be stitched. The method comprises the steps of introducing the margin into a first, generally U-shaped cavity having first and second legs and a bottom joining the legs. Sizing the cavity to allow air to carry the margin through the cavity. Passing air through at least one outlet opening into the first leg and directed toward the bottom to form an airstream in the cavity. Locating the outlet along the first leg and before the bottom, with the airstream moving the margin through the cavity to an end of the second leg opposite the bottom to form the folded margin. Further optional steps may include introducing the margin into a second, generally U-shaped cavity having first and second legs and a bottom joining the legs. Sizing the second cavity to allow air to carry the margin through the second cavity. Passing air through at least one outlet opening into the first leg of the second cavity and directed toward the bottom to form an airstream in the second cavity. Locating the outlet in the second cavity along the first leg and before the bottom of the second cavity, with the airstream moving the margin through the cavity to an end of the second leg opposite the bottom to form the folded margin. Spacing the first and second cavities apart a distance sufficient to stitch the margin between the cavities, and stitching the margin.

Further aspects, features and advantages of the present invention will become apparent from the detailed description of the preferred embodiment that follows.

BRIEF DESCRIPTION OF THE DRAWINGS

The above-mentioned and other features of the invention will now be addressed with reference to the drawings of a preferred embodiment of the present hem forming device. The illustrated embodiment of the hem former is intended to illustrate, but not limit the invention. The drawings contain the following figures, in which like numbers refer to like parts, throughout the description and drawings.

DETAILED DESCRIPTION OF THE PREFERRED EMBODIMENT

The hem former described herein employs some basic concepts, such as a substantially flat planar tongue; one or more blocks with a passageway; a passageway which provides ingress and egress for an airflow; and an airflow within a folded cavity which urges, directs and/or maintains the margin material in a proper position for subsequent stitching of a hem.

Figure 1:
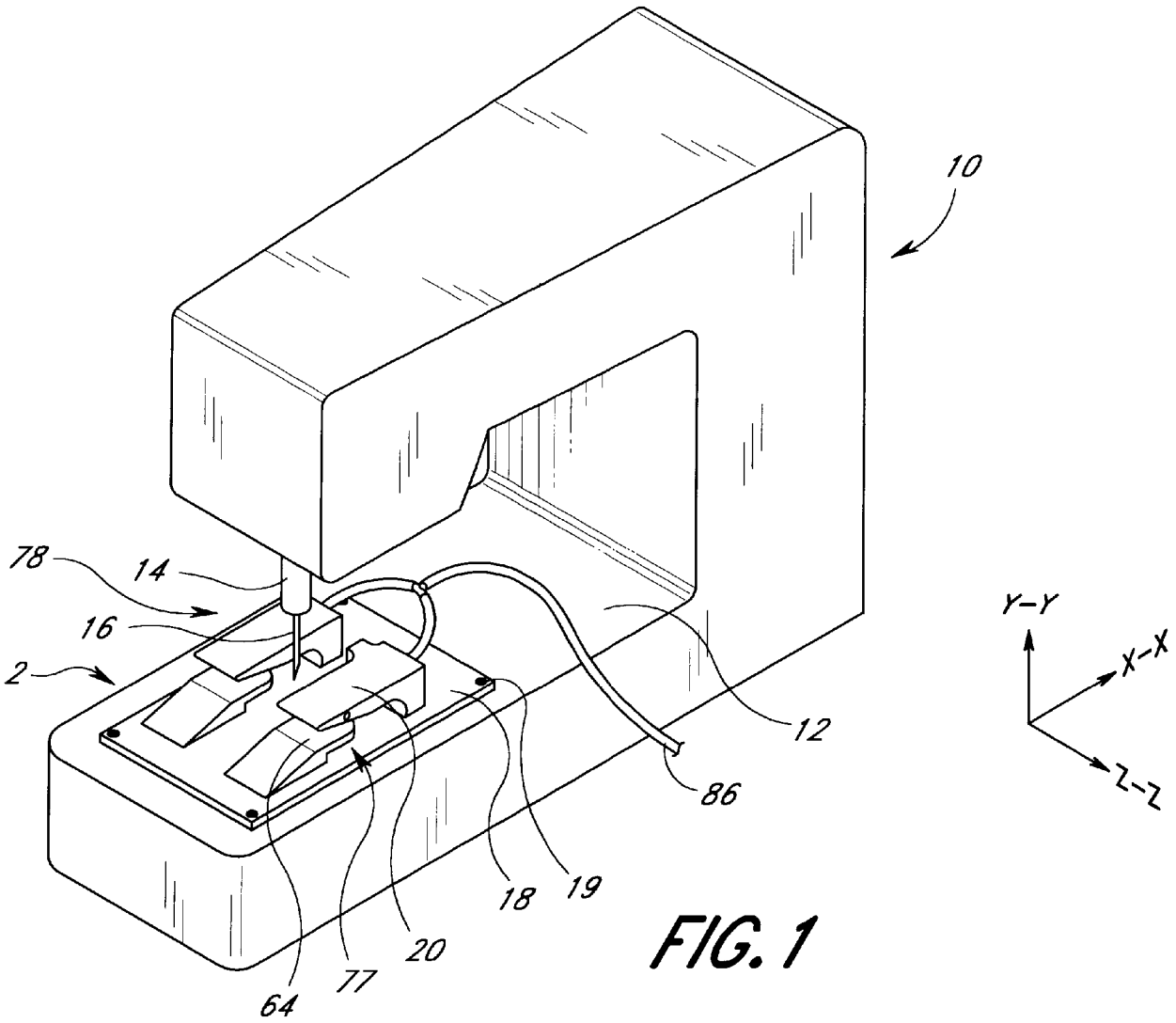
FIG. 1 is a perspective view of a hem former attached to a conventional sewing machine in accordance with the present invention.
Figure 2:
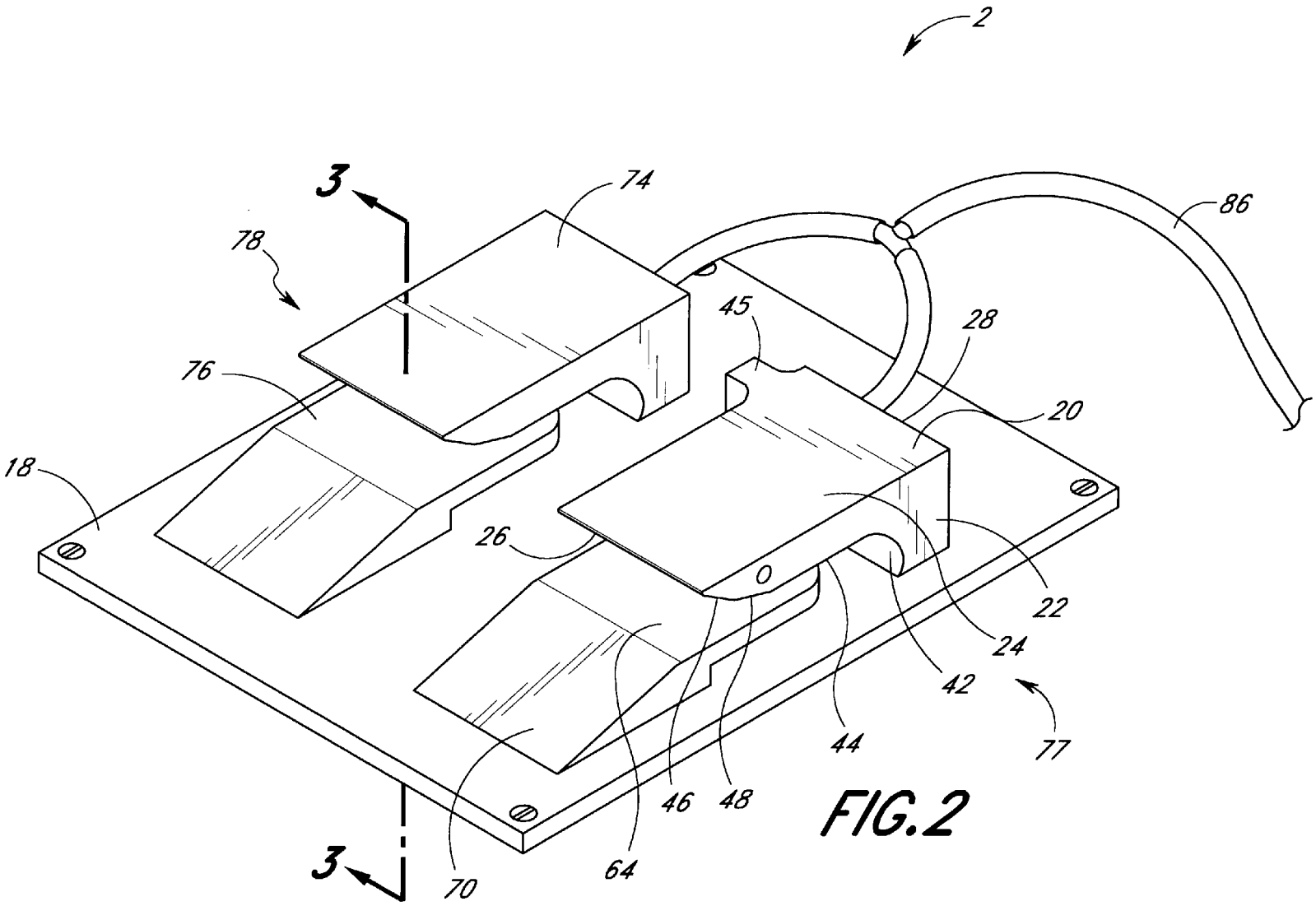
FIG. 2 is a detail view of the hem former illustrated in FIG. 1.

An overview of the hem former is provided below, followed by a more detailed explanation. Referring to FIGS. 1–3, a block 20 extends above the surface of a plate 18. The block 20 has an exterior surface and an opening 30, such as a slot, formed in one side to form an opposing, interior surface 44 facing the plate 18. The opening 30 is elongated and advantageously has a curved end 42 so that air flowing along the interior surface 44 of block 20 toward the end 42 is guided by the curved end 42 to reverse directions and subsequently flow along the plate 18 away from the curved end 42.

An elongated support structure 64 also extends above the surface of the plate 18. The support 64 has an exterior surface 32 and an opposing interior surface 34, both formed on a tongue 36. The tongue 36 placed into the opening 30 so the exterior surface 32 of the support 64 faces the interior surface 44 of the block 20, but is spaced apart therefrom a distance to accommodate margin 13. The interior surface 34 of the support 64 faces, and is spaced apart from, the plate 18 to form a space sufficient to accommodate margin 13. The tongue 36 cooperates with the opening 30 to form a folded cavity 72 having a general "U" shape in cross-section, with the curved end 42 forming the bottom of the "U".

At least one opening, and preferably two openings or outlets 54, 56 are located in the block 20 toward one end of a first leg 41 of the "U" shaped cavity 72. The outlets are in fluid communication with a fluid source, preferably air. The outlets 54, 56 are orientated so that air exiting from the outlets is directed toward the curved end 42. The outlets 54, 56 are sized and angled, and the air flow is sufficient so that the air engages a margin 13 and moves the margin 13 through the "U" shaped cavity 72. The air flow thus moves from the adjacent free end of the first leg 41 of the "U" shaped cavity 72, toward the curved, bottom 42 of the "U" and then toward the blind end of a second leg 43 of the "U" shaped channel 72. The margin 13 is engaged by the air flow adjacent the free end of the first leg 41 of the "U" shaped cavity 72.

The size and length of the "U" shaped cavity 72, and the material forming the margin 13, affect the air flow needed to move the margin 13 through the cavity 72. Further, one or both of the block 20, 74 and support 64, 76 may be moved relative to one another to change the shape, geometry or dimensions of the cavity 72.

The second leg 43 of the "U" shaped cavity 72, between the plate 18 and the support 64, advantageously has a blind end 17 that terminates adjacent to the support 64. The location of that blind end 17 is selected so when the margin 13 is located at the end 17, a hem of appropriate length is formed. Alternatively, the length of the tongue 36 and the opening 30 in the block 20 may be changed to allow hems of differing length. While the end 17 is blind, the cavity 72 advantageously opens onto opposing sides of the support 64 and block 20.

The outlets 54, 56 are angled at about 20 to 60 degrees relative to a plane through the outlets 54, 56 and generally parallel to the tongue 36 which forms the first leg 41 of the "U" shaped cavity 72. To help the margin 13 enter the cavity 72, a free end of the block 20 may have at least a first taper 46 to form a larger opening between the exterior surface 32 of the support 64 and the facing, interior surface 44 of the block 20, which opening narrows toward the outlets 54, 56. Thus, the margin 13 is manually urged into the enlarged opening of the cavity 72 whereupon the air from outlets 54, 56 urges the margin through the cavity 72.

As mentioned, the outlets 54, 56 are advantageously located adjacent a proximal end 26 of the block 20, toward a free end of the first leg 41 of the "U" shaped cavity 72. Advantageously, the outlets 54, 56 are located immediately downstream of the enlarged opening 30 and more advantageously within the first half of the length of the first leg 41 of the "U" shaped channel 72 in which the outlets 54, 56 are located, and preferably between ⅓ and ⅔ of the length of the first leg 41. However, it is believed suitable to place the outlets 54, 56 anywhere along the length of the first leg 41 of the "U" shaped cavity 72, directed toward the curved end 15 of the cavity 72.

To assist in the description of the components and operation of the hem former, the following coordinate terms are used. Referring to FIG. 1, a horizonal axis X—X extends along the depth of the hem former, from a proximal end of the device to a distal end of the device. A vertical axis, Y—Y is generally perpendicular to the horizontal axis and extends along the vertical height of the hem former. A lateral axis Z—Z extends along the width of the hem former from a first side of the device to a second side of the device.

Figure 3A:
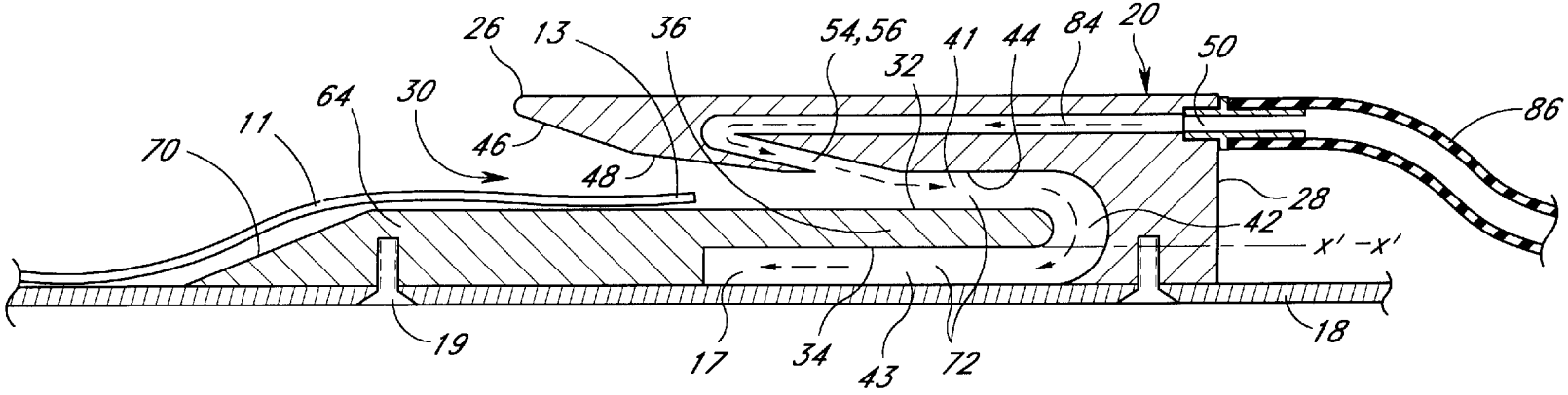
FIG. 3A is a side elevation view of a cavity in the hem former along cut lines 3—3 and shows an airstream entering an inlet port and exiting an outlet port.

Referring to FIGS. 1–3, a conventional sewing machine 10 has a sewing bed 12, sewing head 14 and sewing needle 16. A material 11 to be hemmed has an end or margin 13. The hem former 2 has a first block 20 with at least one inlet port 50 and at least one outlet port and advantageously two outlet ports 54, 56. A passageway 84 (FIG. 3A) connects the inlet port(s) 50 with the outlet ports 54, 56 and is configured such that an airstream can flow through the passageway 84. An operator advances a margin 13 of material 11 along the X—X axis, over a first support 64 and toward the first block 20. When so advanced, the margin 13 communicates with the airstream and is urged, folded and directed into position for subsequent stitching. The air stream engages the surface of the margin 11 that faces the interior surface 44 to urge the margin through the first leg 41. The air stream is generally interposed between the plate 18 and the margin 11 while urging the margin 11 through the second leg 43. Preferably, a second block 74 and second support 76 (i.e., second assembly 78) is constructed and used in a manner similar to the first block 20 and first support 64 (i.e. first assembly 77). The first and second assemblies 77, 78 are laterally spaced apart along the Z—Z axis so that a sewing needle 16 is positioned between the assemblies 77, 78 (FIG. 1). The assemblies 77, 78 and airstream maintain the margin 13 in position until the hem is stitched.

COMPONENTS

As illustrated in FIG. 1, the hem former 2 is advantageously formed on a substantially flat surface, such as a metal or plastic plate 18. Preferably, the plate 18 is configured to generally conform to the shape of a conventional sewing bed 12. The plate 18 allows the hem former 2 to be easily transported as a unitary member and positioned with respect to the sewing machine 10. The plate 18 can be removably attached to the sewing bed 12 by suitable means such as threaded fasteners (nuts and bolts), clamps, clips, adhesives, velcro, magnets, friction locks and the like. The illustrated embodiment depicts a screw 19 located toward the corners of the hem former 2. However, the plate 18 can also be permanently affixed to the sewing bed 12 by suitable means such as bolting, soldering or adhesives. Permanent affixation is preferred if the same material 11 to be hemmed is used with the same sewing machine 10 for prolonged periods, because, once properly set up, subsequent adjustment is not needed. Alternatively, the hem former 2 can be permanently mounted directly onto the sewing bed 12 without use of the plate 18.

FIGS. 2–3 show a generally inverted L-shaped first block 20. The block 20 has a free, proximal end 26 and a distal end 28 positioned toward opposing ends of the block 20 along the longitudinal X—X axis. The block 20 comprises an L-shaped member having a short, vertical section 22 and a longer, horizontal section 24. The vertical section 22 preferably has a substantially flat distal end which corresponds with the distal end 28 of the block 20 and a proximal end which corresponds with the curved end 42 of the opening 30. The curved end 42 advantageously forms a substantially U-shaped curve with a radius of curvature of approximately 0.2 to 2 mm. However, the curved end 42 may be curved to a greater or lesser extent or even be curvilinear, linear or angled so long as the curved end 42 can direct a stream of air (explained below). The horizontal section 24 of the block 20 has a substantially flat upperside and a substantially flat underside 44 which corresponds with the interior surface 44 of the block 20.

The block may incorporate a protuberance or plurality of protuberances. FIG. 2 shows a protuberance 45 located toward the distal end 28 of the block 20. The protuberance, if used, allows the block 20 to be form-fit around the sewing machine 10, needle 16 or other element. Similarly, the block 20 may incorporate an indent, depression, hollow or plurality of thereof (not shown) to similarly allow the block 20 to be form-fit around the sewing machine 10, needle 16 or other element.

Still referring to FIGS. 2–3, the proximal end 26 of the block 20 is optionally tapered so that the block 20 can better accommodate an internal passageway (detailed below). The proximal end 26 has a first taper 46 angled at approximately 30 to 50 degrees below the horizontal X—X axis and extends approximately 0.2 to 2 mm toward the distal end 28 of the block 20. Advantageously, a second taper 48 communicates with the first taper 46. The second taper 48 is angled approximately 20 to 40 degrees relative to the horizontal, X—X axis and extends approximately 0.2 to 2 mm toward the distal end 28 of the block 20. Again, there is no requirement that one or more tapers be used. Rather, the free, proximal end 26 of the block 20 can be geometrically arranged in a linear, curved, curvilinear or angular manner so long as it does not interfere with the passageway (detailed below).

Figure 3B:
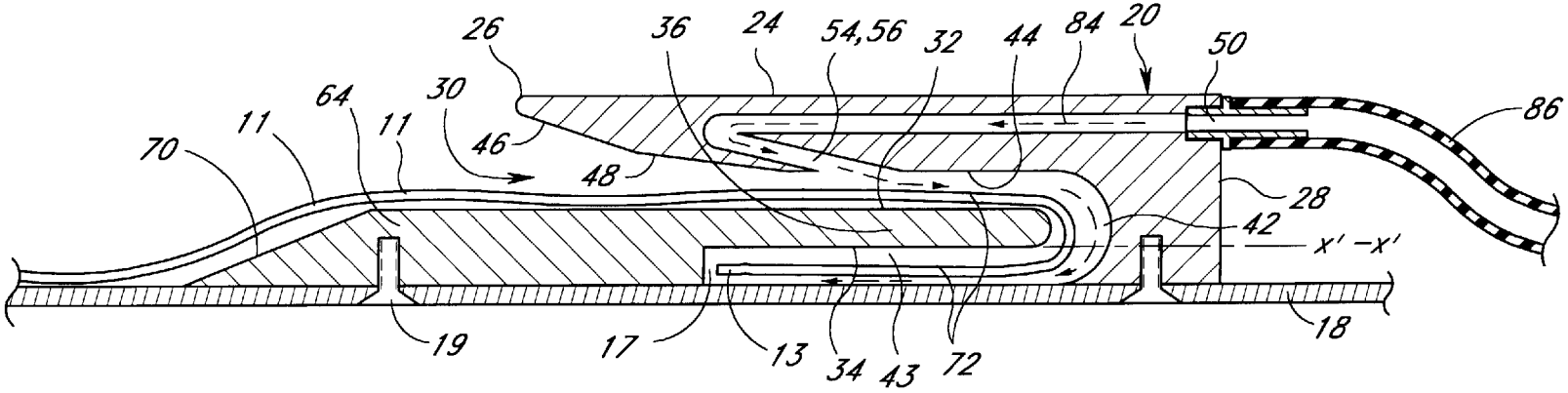
FIG. 3B is a side elevation view of the cavity of the hem former along cut lines 3—3 and shows an airstream entering the inlet port, urging and directing a margin around a tongue, and exiting the outlet ports.
Figure 4:
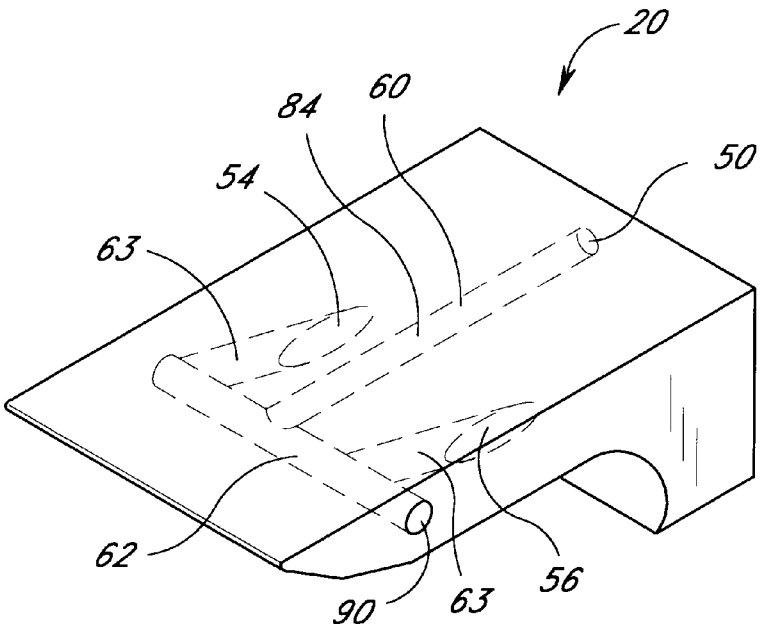
FIG. 4 is a perspective view of the passageway formed in a block portion of the hem former.

As illustrated in FIGS. 3 and 4, the block 20 has at least one inlet port and at least one outlet port to provide an avenue for air flow. Preferably, the block 20 has one inlet port and two outlet ports. However, as will be understood by one skilled in the art and explained below, there is no requirement that an ascertained quantity of inlet and outlet ports be used.

FIG. 3A shows an inlet port 50 formed on the distal end 26 of the block 20 which connects to a pressurized air source (not shown) by an intake connector 86. However, the inlet port 50 may be formed anywhere on the block 20 so long as the inlet port 50 provides ingress for pressurized air flow. The inlet port 50 is advantageously geometrically configured as a circle for ease of manufacture, however, other configurations such as a oval, square, polygon or the like may be used. The diameter of the inlet port 50 is preferably 0.2 to 2 mm and more preferably about 0.5 mm. However, these dimensions will vary depending on the application of the hem former 2. For example, thicker materials may require a larger, stronger airstream and thus a larger inlet port 50.

Figure 5:
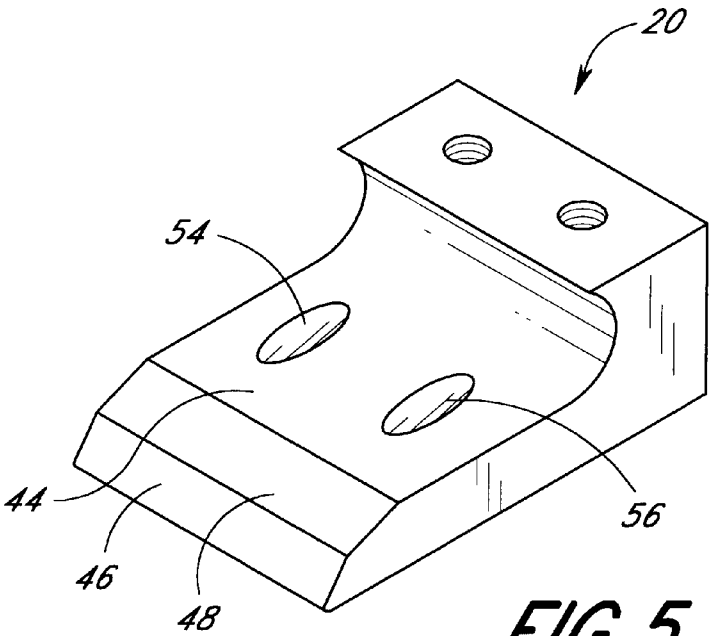
FIG. 5 is a perspective view of the underside of the block portion of the hem former and details the outlet ports.

Two outlet ports 54, 56 are preferably formed vertically above a centerline X'–X'. The centerline X'—X' is parallel to the bottom of the tongue 36. Two outlet ports arranged on the underside 44 of the horizontal section 24 of the block 20. However, the outlet ports 54, 56 may be formed anywhere on the block 20 so long as the outlet ports 54, 56 provide ingress for pressurized air flow. FIG. 5 more closely illustrates the first and second outlet ports 54, 56.

FIGS. 3 and 5 best show the preferred locations of the first and second outlet ports 54, 56 with respect to the block 20. Preferably, there is a distance of approximately 0.2 to 2 mm between the first outlet port 54 and the first side 30 of the block 20, and a similar distance of approximately 0.2 to 2 mm between the second outlet port 56 and the second side 32 of the block 20. The first and second outlet ports 54, 56 are spaced apart a distance of approximately 0.4 to 4 mm. However, these dimensions will vary depending on the application of the hem former 2. For example, thicker materials may require a larger, stronger airstream and thus a smaller spacing between ports. If a taper is used, the outlet ports are preferably located along the horizontal X—X axis beyond the taper.

The outlet ports 54, 56 are advantageously tubes having a circular cross section, but because the outlet ports 54, 56 exit the interior surface 44 of the block 20 at an angle, the outlet ports 55, 56 are substantially oval shaped when viewed perpendicular to the plane formed by the X–Z plane rather than circularly shaped. Similarly, if the tube forming outlet ports 54, 56 is configured as a square cross-section, then this orientation would cause the outlet ports 54, 56 to be substantially rectangularly shaped when so viewed.

The outlet ports may be tapered or otherwise modified to more precisely direct the airstream, as will be understood by one skilled in the art. For example, the outlet ports may be funnel-shaped to concentrate the airstream or inverse funnel-shaped to disperse the airstream. Similarly, the outlet ports can comprise a relatively large quantity (10–100 or more) of small orifices arranged and/or dispersed about the block 20 to direct the airstream. Air exists the outlet ports 54, 56 at an angle so the airstream impacts the surface 32 of the tongue 36 at an angle of about 20 to 60 degrees.

FIG. 4 shows a passageway 84 which connects the inlet and outlet ports 50, 54, 56. The passageway 84 provides an avenue for air flow. The passageway 84 preferable has a first path 60, a second path 62, and a third path 63. The first path 60 extends from the inlet port 50 toward the proximal end 26 of the block 20 substantially along the horizontal X—X axis. The second path 62 is preferably perpendicular to the first path 60 and runs substantially along the Z—Z axis. The length of the second path 62 extends substantially along the lateral width of the block 20. The third path 63 communicates with the second path 62 and outlets 52, 54. The path 62 and outlets 52, 54 are angled approximately 20 to 60 degrees below the horizontal X–Z plane when the block 20 is orientated as shown in FIG. 1. The passageway need not be internal to the block 20. Rather, the passageway can be formed by other suitable devices, such as a hollow tube coupled to the block 20 or similar structure.

FIGS. 2 and 3 illustrate a support 64 with a substantially flat planar tongue 36. The tongue 36 extends along the X–Z plane axes toward the distal end 28 of the block 20. A ramp 70 is optionally formed integrally with the tongue 36 so that the material 11 can be elevated from the sewing bed 12 to the tongue 36. The ramp 70 allows the material 11 to remain in communication with the support 64 so that the hem operator need only slide the material 11 up the ramp 70 rather than pick up the material and place it on the support 64.

The tongue 36 is interposed between the interior surface 44 of the block 20 and the plate 18. When so arranged, a folded cavity 72 is formed between the tongue 36 and block 20.

Referring to FIGS. 1 and 2, the hem former 2 may optionally use a second block 72 and a second support 76 forming a second assembly 78 that is identical to the first assembly 77 and differs only in position with respect to the sewing machine 10. If a second assembly 78 is used, the first and second assemblies 77, 78 are laterally spaced apart with the sewing needle 16 positioned between the first and second assemblies 77, 78. The first and second assemblies 77, 78 are preferably symmetrically located on opposing sides of the needle 16, with a distance of approximately 2 to 20 mm between the first assembly 77 and the needle 16 and a distance of approximately 2 to 20 mm between the second assembly 78 and the needle 16. However, the dimensions and orientation will vary depending on the application of the hem former 2. For example, thicker materials will require a larger, stronger air stream and thus a closer orientation of the assemblies 77, 78.

The first assembly 77 and second assembly 78 (if used) are preferably moveable relative to the sewing bed 12. That is, the assembly(s) 77, 78 can be horizontally adjusted along the X—X axis to best position the assemblies 77, 78 with respect to material 11 to be hemmed and the needle 16. Suitable incremental adjustment devices comprises a groove and notches respectively formed on the hem former 2 and sewing bed 12 (or plate 18), a nut and bolt assembly, a pin and a series of receptacles, a ladder and rung, paired ribs and grooves and the like. The assemblies 77, 78 can similarly be laterally adjusted along the Z—Z axis to best position the assemblies 77, 78 with respect to material 11 to be hemmed and the needle 16. A suitable adjustment device similar to the horizontal adjustment device is used. This horizontal and transverse moveable element (not shown) allows the hem former to quickly and easily adjust for different types of materials.

A connector (not shown) forms a flat planar surface between the sewing needle 16 and sewing bed 14 and is generally level with the supports 64, 76. The connector supports the material 11 located between the first and second assemblies 77, 78. The connector has an opening directly below the needle 16. The opening insures that the needle 16 does not contact the sewing bed 12, plate 18, support 64 or any other element when the hem is stitched. The connector can take the form of a separate element or can be integrally formed with the first and second assemblies 77, 78 or portions thereof.

OPERATION

If a hem former 2 with the first and second assembly 77, 78 is used, the assemblies 77, 78 are preferably laterally disposed between the sewing needle 16. If only the first assembly 77 is used, the assembly is preferably laterally disposed adjacent to the sewing needle 16. Because the operation of the hem former 2 is preferably identical if either one or two assemblies are used and differs only in the position relative to the needle 16, the description will detail only the operation when the first and second assemblies 77, 78 are used and it is understood that a single assembly may operate in a like manner.

As depicted in FIG. 3A, an air flow 84 is introduced into the inlet port 50 by conventional means such as a pressurized air source or compressor (not shown). An intake connector 86 connects the pressurized air to the inlet port 50. The air pressure is adjusted by conventional pressure and release values (not shown). FIG. 4 shows an optional bleed valve 90. The bleed value 90 connects to the second path 62. When the value 90 is in an open position, air can escape through the valve 90, thereby lowering the air pressure along the outlet ports 54, 56. Varying the amount the valve 90 is closed or open, varies the air pressure along the outlet ports 54, 56.

The air is preferably at a pressure of 10 to 50 pounds per square inch (psi) and more preferably 20 to 40 psi. However, the flow rate can easily vary approximately +/−30% when a t-shirt material of conventional size and thickness is used. If thicker material is to be hemmed, for example a wool pant leg, then the air pressure should preferably be at a pressure of 30 to 80 psi and more preferably 40 to 50 psi, although this flow rate can easily vary at approximately +/−30%. If too little pressure is used, the airstream will have insufficient force to urge the margin 13. Similarly, if too great of a pressure is used, the airstream will have too much force and urge the margin 13 so that it bunches at the blind end 17. Thus, irrespective of the above exemplary pressure quantities, the best pressure amount to be used is that which allows the margin to be urged toward and around the curved end 15 so that the margin 13 reverses direction at the curved end 15, and continues toward the blind end 17 without significantly bunching at the blind end 17 such that sewing a hem would be significantly inhibited.

Referring back to FIG. 3A, once the air is introduced into the inlet port 50, the air flows through the passageway 84 toward the outlet ports 55, 56. As explained above, the outlet ports 54, 56 are preferably configured to direct the airstream in an angular direction with respect to the sewing bed. When so directed the airstream flows through the folded cavity 72. Expressed in different terms, the airstream is substantially constrained to flow between the interior surface 44 of the block 20 and the tongue 36. Due to the angle at which the airstream exits from the outlet ports 54, 56, the airstream is further directed toward the distal end 28 of the block 20 until it contacts the curved end 42 of the folded cavity 72. The shape of the curved end 42 and the outlet port 54, 56 pressure then redirects the airstream around and below the tongue 36. After such reversal of direction, the airstream flows between the tongue 36 and the plate 18 toward the proximal end 26 of the block.

As shown in FIG. 3B, an operator can slide the material 11 up the ramp 70 and onto the tongue 36, with the margin 13 forming a leading edge. As the margin 13 continues in this direction, it enters the airstream that is directed toward the tongue 36 and toward the curved end 42. Upon entering the airstream, the margin 13 is carried by the airstream in the same direction as the airstream, that is, through the folded cavity 72.

This action by the airstream on the margin 13 is especially effective because the airstream directly communicates with the margin 13 before the margin 13 is deflected, altered or otherwise inhibited by the tongue 36 or any other element. Thus, positioning the airstream and margin 13 so that they communicate with each other before the airstream communicates with any other element (after egressing from the outlet ports 54, 56) is especially important. The illustrated embodiment achieves this preferential action by positioning the margin 13 between the outlet ports 54, 56 and the tongue 36.

The positioning of the outlet ports 54, 56 on the interior surface 44 of the block 20 and above the tongue 36 is also preferred because it reduces the effort required of the hem operator. That is, this positioning only requires that the operator push the material 11 up the ramp 70 and onto the tongue 36. After so positioning, the airstream does the rest of the work to urge, fold and position the margin 13. By this design, operator error which can cause snagging or misalignment of the material 11 is overcome. Equally important, additional operator time to further direct the margin is not required.

As will be understood by one skilled in the art, other designs can be used to achieve the same preferential airstream action. For example, the orientation of the hem former 2 can be inverted such that the airstream emanates from below the tongue 36 and the margin 13 enters from below the tongue 36.

The maintenance of the proper hem forming position is preferably achieved by cooperative use of the first and second assemblies 77, 78. That is, when the first and second assemblies 77, 78 are used, the margin is folded back on opposing sides of the needle 16 and across the upper surface of the support 64. By folding the material 11 back on both sides of the needle 16, the proper margin 13 positioning can be better maintained than if the margin 13 was only folded back on one side of the needle 16. When only one hem former is used, the margin has a tendency to turn, cant or rock from the unidirection application of the airstream force. When dual hem formers are positioned on opposing sides of the margin, the turning, canting or rocking is minimized and potentially eliminated, thus maintaining the margin on opposing sides until the needle has stitched the hem.

A proper hem forming position can also be better achieved by adjusting the lateral distance between the assemblies 77, 78 as described above. This lateral movement of the assemblies 77, 78 allows the airstream force to vary with respect to the material 11 and needle 16. Thus, different margin 13 thicknesses can be stitched without having to necessarily modify the air pressure.

It is also understood that the invention can operate in a manner where the airflow, instead of being blown through the passageway 84, is sucked from the passageway 84. Thus, instead of forcing pressurized air into an inlet port(s) and through the passageway 84, air is sucked from the inlet port(s) and through the passageway 84 by a vacuum or similar apparatus. Also, the invention can operate through the use of gases other than air depending on the particular needs. For example, inert gasses such as nitrogen, reactive gasses, or combinations thereof.

In the preferred embodiment, the assemblies are constructed of stainless steel. Stainless steel is chosen for its strength, ease of manufacture and low cost. Moreover, stainless steel can be polished to a smooth surface which assists the airstream in urging, directing and maintaining a proper position of the margin material for subsequent stitching of a hem. However, there is no requirement that stainless steel be used. Rather, other metals, plastics, composites and the like may be used depending on the requirements which are demanded of the device.

The hem former is discussed in the context of a sewing apparatus which can fold a margin of a foldable material and then stitch the margin onto the material to form a hem. However, it should be understood that the present invention is applicable to other foldable materials. For example, paper, thin plastic, rubber and the like can be folded and stitched by the device of the present invention. One skilled in the art may find additional applications for the device disclosed herein. Thus, the illustration and description of the hem former in connection with a sewing machine is merely exemplary of one possible application of the apparatus for folding margins.

The embodiments illustrated and described above are provided merely as examples of the folding apparatus constructed in accordance with the present invention. Other changes and modifications can be made from the embodiments presented herein by those skilled in the art without departure from the spirit and scope of the invention, as defined by the appended claims.

What is claimed is:

1. An air-enhanced hem former for folding a margin of a foldable material to be stitched, comprising:

a first cavity having first and second legs and a bottom joining the legs, the cavity sized to allow air to carry the margin through the cavity, at least one outlet opening into the first leg and directed toward the bottom to introduce an airstream into the cavity, the outlet opening being located along the first leg and before the bottom.

2. The hem former as defined in claim 1, wherein the bottom is curved.

3. The hem former as defined in claim 2, wherein the bottom is generally U-shaped.

4. The hem former as defined in claim 1, wherein the first leg is generally linear and extends along a longitudinal axis.

5. The hem former as defined in claim 1, wherein the second leg is generally linear and extends parallel to the first leg and spaced apart from the first leg by the bottom.

6. The hem former as defined in claim 1, further comprising, a second cavity having first and second legs and a bottom joining the legs, the second cavity sized to allow the airstream to carry the margin through the second cavity, at least one outlet opening into the first leg of the second cavity and directed toward the bottom of the second cavity to introduce an airstream into the second cavity, the outlet being located along the first leg and before the bottom of the second cavity, the first and second cavities being aligned so a margin can be inserted through the first and second cavities, the first and second cavities being spaced apart a distance sufficient to allow a needle to sew the margin between the cavities.

7. The hem former as defined in claim 6, wherein the outlet opens into the cavity within the first ⅔ of the length of the first leg.

8. The hem former as defined in claim 7, wherein the outlet port is orientated at an angle of about 20°–60° relative to a longitudinal axis of the first leg and in a direction toward a longitudinal axis of the second leg.

9. The hem former as defined in claim 1, wherein the second leg terminates in a blind end.

10. The hem former as defined in claim 6, wherein the second leg terminates in a blind end.

11. The hem former as defined in claim 6, wherein at least one of the first and second cavities is formed by a block having a slot in one side terminating interior to the block, and a tongue inserted into the slot to form the legs, the tongue having a distal end that terminates before contacting the interior end of the slot in the block to define the bottom of the cavity.

12. The hem former as defined in claim 1, wherein the outlet opens into the cavity within the first ⅔ of the length of the first leg.

13. The hem former as defined in claim 12, wherein each outlet port is tapered to disperse the airstream.

14. The hem former as in claim 12, wherein each outlet port is tapered to concentrate the airstream.

15. The hem former as defined in claim 12, wherein the outlet port is orientated at an angle of about 20°–60° relative to a longitudinal axis of the first leg and in a direction toward a longitudinal axis of the second leg.

16. An air-assisted sewing apparatus for folding a margin of a foldable material to be stitched, comprising:

a first passageway formed by a first and second generally parallel legs joined by a bottom, the first leg having an end opposite the bottom that forms an opening into which the margin is introduced to the passageway, an outlet in fluid communication with an air source and orientated to introduce an airstream into the first leg directed toward the bottom, the size of the first passageway and the airstream cooperating to move the margin through the passageway and into the second leg;

a second passageway constructed as the first passageway, the second passageway being generally parallel to and separated from the first passageway a distance sufficient to allow a needle to stitch the margin between the passageways.

17. The hem former as defined in claim 16, wherein the cavity is generally U-shaped.

18. The hem former as defined in claim 16, wherein the outlet is located between about ⅓ and ⅔ the length of the first leg.

19. The hem former as defined in claim 16, wherein the outlet is orientated at an angle of about 20°–60° relative to a longitudinal axis of the first leg and in a direction toward a longitudinal axis of the second leg.

20. The hem former as defined in claim 16, wherein the opening is enlarged a distance sufficient to facilitate introduction of the margin into the cavity and the outlet is not located in the enlarged portion.

21. The hem former as defined in claim 20, wherein the outlet is orientated at an angle of about 20°–60° relative to a longitudinal axis of the first leg and in a direction toward a longitudinal axis of the second leg.

22. A sewing apparatus for folding a margin of a foldable material to be stitched, comprising:

a first cavity having a U-shaped portion formed by a first and second generally parallel legs joined by a curved bottom, the first leg having an end opposite the bottom that forms an opening into which the margin is introduced to the cavity; and first airflow means in fluid communication with the first leg for moving the margin through the cavity into the second leg.

23. A sewing apparatus as defined in claim 22, further comprising:

a second cavity having a U-shaped portion formed by a first and second generally parallel legs joined by a curved bottom, the first leg of the second cavity having an end opposite the bottom that forms an opening into which the margin is introduced to the second cavity; and second airflow means in fluid communication with the first leg of the second cavity for moving the margin through the second cavity to an end of the second leg of the second cavity, the second cavity being aligned with the first cavity and separated from the first cavity a distance sufficient to allow a needle to stitch the margin between the cavity.

24. The hem former as defined in claim 23, wherein the outlet is orientated at an angle of about 20°–60° relative to a longitudinal axis of the first leg and in a direction toward a longitudinal axis of the second leg.

25. A method for folding a margin of a foldable material to be stitched, comprising the steps of:

introducing the margin into a first, generally U-shaped cavity having first and second legs and a bottom joining the legs, sizing the cavity to allow air to carry the margin through the cavity passing air through at least one outlet opening into the first leg and directed toward the bottom to form an airstream in the cavity, locating the outlet along the first leg and before the bottom, the airstream moving the margin through the cavity and into the second leg opposite the bottom to forms folded margin.

26. A method as defined in claim 25, comprising the further step of introducing the airstream into the cavity at an angle of about 20°–60° relative to a longitudinal axis of the first leg and in a direction toward a longitudinal axis of the second leg.

27. A method as defined in claim 25, comprising the further steps of:

introducing the margin into a second, generally U-shaped cavity having first and second legs and a bottom joining the legs, sizing the second cavity to allow air to carry the margin through the second cavity, passing air through at least one outlet opening into the first leg of the second cavity and directed toward the bottom to form an airstream in the second cavity, locating the outlet in the second cavity along the first leg and before the bottom of the second cavity, the airstream moving the margin through the cavity and into the second leg opposite the bottom to form the folded margin, spacing the first and second cavities apart a distance sufficient to stitch the margin between the cavities, and stitching the margin.

28. A method as defined in claim 27, comprising the further step of placing the outlet to introduce air into the cavity within the first ⅔ of the length of the first leg.

29. A method as defined in claim 27, comprising the further step of placing the outlet to introduce air into the cavity within the first ⅔ of the length of the first leg.

30. A method as defined in claim 27, comprising the further step of placing the outlet to introduce air into the first cavity within the first ⅔ of the length of the first leg of the first cavity and to introduce air into the second cavity within the first ⅔ of the length of the first leg of the second cavity.

31. A method as defined in claim 27, comprising the further step of introducing the airstream into the first and second cavities at an angle of about 20°–60° relative to a longitudinal axis of the first leg of each cavity and in a direction toward a longitudinal axis of the second leg of each cavity.

32. A method as defined in claim 27, wherein the cavity is formed by placing a tongue into a cavity in a block to define the U-shaped cavity, and comprising the further step of moving one or both of the tongue and block to vary the cavity to allow movement of the margin.

33. A method for positioning a margin of a foldable material to be stitched by passing the material through a U-shaped cavity having first and second legs joined by a bottom, the first leg having an opening for introduction of the margin and the second leg having an end to limit movement of the margin, comprising the steps of:

introducing a first air stream adjacent the opening in the first leg and directed toward the bottom;

introducing the margin into the cavity a distance sufficient to engage the first air stream; and moving the margin by the air stream to the end of the second leg.

34. A sewing apparatus as defined in claim 33, further comprising the step of sewing the margin.

35. A method as defined in claim 33, comprising the further step of introducing air into the cavity within the first ⅔ of the length of the first leg.

36. A method as defined in claim 33, comprising the further step of introducing the airstream into the cavity at an angle of about 20°–60° relative to a longitudinal axis of the first leg and in a direction toward a longitudinal axis of the second leg.

37. A method as defined in claim 33, wherein the cavity is formed by placing a tongue into a passageway in a block to define the U-shaped cavity, and comprising the further step of moving one or both of the tongue and block to vary the cavity to allow movement of the margin.

* * * * *